US005810163A

United States Patent [19]

Nakabayashi

[11] Patent Number: 5,810,163

[45] Date of Patent: Sep. 22, 1998

[54] HOLDER STRUCTURE FOR FILM CARTRIDGE AND FILING-BOX TYPE ALBUM

[75] Inventor: Itoichi Nakabayashi, Osaka, Japan

[73] Assignee: Nakabayashi Co., Ltd., Osaka, Japan

[21] Appl. No.: 834,487

[22] Filed: Apr. 14, 1997

[30] Foreign Application Priority Data

Apr. 15, 1996 [JP] Japan ..... 8-118375
May 27, 1996 [JP] Japan ..... 8-156260

[51] Int. Cl.[6] ..... B65D 69/00; B65D 85/67

[52] U.S. Cl. ..... 206/232; 206/391; 206/455; 206/472; 206/488; 206/489

[58] Field of Search ..... 206/389, 391, 206/455, 472, 485, 486, 488, 489, 225, 232

[56] References Cited

U.S. PATENT DOCUMENTS

| | | | |
|---|---|---|---|
| 3,322,269 | 5/1967 | Neyer | 206/488 |
| 3,708,061 | 1/1973 | Weingarden et al. | 206/391 |
| 5,209,352 | 5/1993 | Light et al. | 206/391 |
| 5,251,744 | 10/1993 | Dziersk et al. | 206/232 |
| 5,251,745 | 10/1993 | Repp et al. | 206/232 |
| 5,251,746 | 10/1993 | Gresh et al. | 206/232 |
| 5,251,747 | 10/1993 | Hansen et al. | 206/232 |
| 5,263,579 | 11/1993 | Blackman | 206/232 |
| 5,271,497 | 12/1993 | Blackman et al. | 206/232 |
| 5,303,825 | 4/1994 | Hansen et al. | 206/389 X |
| 5,429,245 | 7/1995 | Tanibata | 206/391 X |

FOREIGN PATENT DOCUMENTS

| | | |
|---|---|---|
| 7244366 | 9/1995 | Japan . |
| 7244367 | 9/1995 | Japan . |
| 3021811 | 12/1995 | Japan . |

*Primary Examiner*—Bryon P. Gehman
*Attorney, Agent, or Firm*—Thompson Hine & Flory LLP

[57] ABSTRACT

A holder structure for allowing a film cartridge of the Advanced Photo System to be stored and retrieved and a filing-box type album that incorporates the holder structure. The holder structure is constructed by forming a storage socket of a substantially identical shape to the lower half of a film cartridge and by extending a clamping plate portion having a locking projection in parallel with the storage socket. A container for film cartridges having the holder structure is inserted along with a pocket album in the outer casing of the filing-box type album. The container is identical to each of the pocket albums in style, or is a box-shaped container that is inserted above or below the pocket albums in a drawer fashion.

7 Claims, 8 Drawing Sheets

HOLDER STRUCTURE FOR FILM CARTRIDGE AND FILING-BOX TYPE ALBUM

BACKGROUND OF THE INVENTION

1. Field of the Invention

The present invention relates to a holder structure that holds a film cartridge in an easily detachable manner for use with the so-called "Advanced Photo System" proposed lately. The present invention also relates to a filing-box type album comprising a plurality of album books having a consistent design, an outer casing having the same design for storing the album books, and a container having the holder structure for film cartridges which is housed along with the album books into the outer casing.

2. Description of the Related Art

In a photographic development process system for a conventional 35-mm film, a negative film taken out of a film cartridge is cut into segments by several frames, and segmented negative films are returned in a pocket made of a semi-transparent film to customers. The customer may keep them in an available box. A negative film holding pocket may be attached onto a negative film mount and then bound together with a photomount, on which photographs are glued, in an album.

The recently proposed Advanced Photo System employs a newly standardized miniature film, which replaces the conventional 35-mm film, and a camera compatible with the new miniature film format. The miniature film is stored in a special film cartridge. The film continuously stays inside the film cartridge throughout all the processes from loading into the camera to development after picture shooting.

The negative film after development is rewound into the film cartridge. The developed negative film is returned in the cartridge to a customer. Since the customer cannot directly check the content of the negative film, each film cartridge is labelled with a unique ID number. The cartridge is usually associated with an index print. The index print is a photographic paper which presents all images born by the negative film and the ID number thereon.

The film cartridge will be discussed further below. As shown in FIG. 2, the film cartridge has a generally oblong shape elongated along its one diagonal line in its cross section. The film cartridge has one portion further projected at one end of the diagonal line serving as an exit port 3*a* for the film. The maximum diagonal length (L1) across the cartridge is 30 millimeters, the height or minimum diagonal length (L2) across the cartridge is 21 millimeters, and the width (W) of the cartridge is 39 millimeters. The top surface, above the exit port 3*a*, of the cartridge bears a unique ID number 3*b*. The film cartridge is labeled, on its one side, with four types of marks 3*c* associated with numbers.

In the discussion that follows, the position of the film cartridge is referenced relative to its position with the ID number facing upward as shown in FIG. 2.

As described above, in the new Advanced Photo System, the negative film is returned in a cubical structure in the film cartridge rather than in a planar structure in the pocket to the customer. For this reason, there is a need for a container that efficiently stores such a film cartridge and a holder structure for use in the container.

Generally available as storage means for holding and storing a cubical object is a structure in which a storage socket slightly smaller than the object is formed in a plate of a synthetic resin such as urethane so that the object is elastically directly inserted and held in the socket. In another structure, such a storage socket is set to be somewhat deeper to accommodate an object therein and a clamp member is formed on the opening of the socket to prevent the object from slipping out of the socket.

In these structures, the object is held and clamped by elasticity of the material of the plate. To pull the object out of the socket against elasticity, some force is required. As pulling means, a notch of a finger size is formed on one side of the storage socket or a pulling strap is provided in each storage socket. Such arrangements make the manufacturing of the structures costly and time-consuming. When a number of objects are stored, the spacing between the storage sockets needs to be wide enough to allow each of the objects to be pulled out without interference therebetween. The number of objects to be stored is thus small.

There is a commercially available filing-box type album, in which a plurality of pocket albums having a consistent decorative cover with, for example, a popular character or a fancy design, are stored in an outer casing that has also the consistent cover design. Such a filing-box type album is now in widespread use because it allows a number of photographic prints to be stored in an easy and efficient manner. As already described above, each film cartridge is labeled with its unique ID number and is associated with the index print which is a photographic paper bearing all images born by the negative film and the ID number thereon. For this reason, the photographic prints, the index print and the film cartridge of the negative films are preferably stored together in the same place. The conventional filing-box type album assumes no storage of such bulky cubical cartridges.

SUMMARY OF THE INVENTION

Accordingly, it is an object of the present invention to provide a holder structure, in which a film cartridge is easily and reliably mounted and detached, into and out of, a storage socket in combination with clamping means, adapted to the shape of the film cartridge. When a storage mount is provided with a plurality of storage sockets, the spacing between the sockets is narrowed such that more film cartridges are stored.

It is another object of the present invention to provide a low-cost filing-box type album in compliance with the new Advanced Photo System, in which the cartridge of the negative film is stored together with the photographic prints by inserting a container loaded with a plurality of film cartridges in the outer casing of the filing-box type album.

To achieve these objects, the present invention comprises a mount of a synthetic resin comprising a holder structure comprising a storage socket being substantially identical in shape to the lower half of a film cartridge so that the lower half of the film cartridge is completely received in the storage socket, and a clamping plate portion which runs in parallel with the storage socket and which is spaced away from the storage socket by a distance corresponding to the projection of a film exit port of the film cartridge, wherein the clamping plate portion has, on the side of the top portion facing the storage socket, a locking projection that engages with the top edge of the frame of the film exit port.

The holder structure of the film cartridge allows the film cartridge to be seated in the storage socket, with the film cartridge elastically clamped between the locking projection formed on the clamping plate portion and the far edge of storage socket in the opposite side across the storage socket. By pressing the clamping plate or the film exit port exposed next to the clamping plate portion, the engagement of the clamping plate portion is released such that the film cartridge may be easily pulled out of the storage socket.

In the filing-box type album storing a plurality of pocket albums, the container of the film cartridge is stored in the outer casing of the album. The container is constructed in a fashion similar to a pocket album, and more specifically, a plurality of storage sockets for film cartridges are formed on the top of the mount, and a cover is attached to the mount on one side so that the cover is opened from the mount in a spread fashion and then closed to cover the mount.

The container may have a box-like shape so that it is housed in the top portion or the bottom portion of the outer casing of the filing-box type album in a drawer fashion. Furthermore, a partition is attached inside the outer casing of the filing-box type album to separate the pocket albums from the container.

Since the filing-box type album stores pocket albums (photographic prints) and film cartridges together, dispersing of negative films is prevented and the conventional pocket albums are continuously used with the outer casing of the filing-box type album of the present invention.

DETAILED DESCRIPTION OF THE PREFERRED EMBODIMENT

Figure 1A:
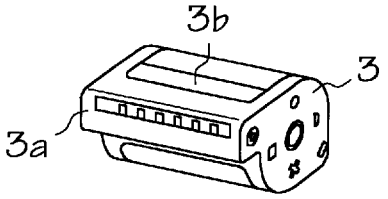
FIG. 1A is a perspective view showing a holder structure of the present invention.
Figure 1B:
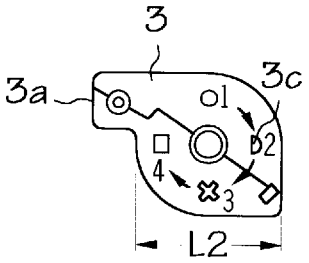
FIG. 1B is a partial cross-sectional view of the holder structure.
Figure 1C:
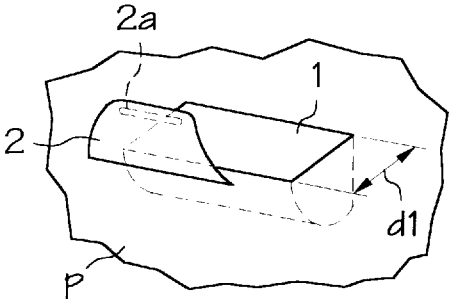
FIG. 1C is a partial perspective view of a storage socket.
Figure 1D:
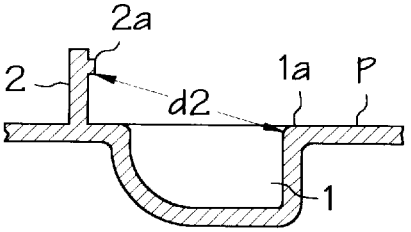
FIG. 1D is a cross-sectional view of a mount in which the storage socket is formed.
Figure 2:
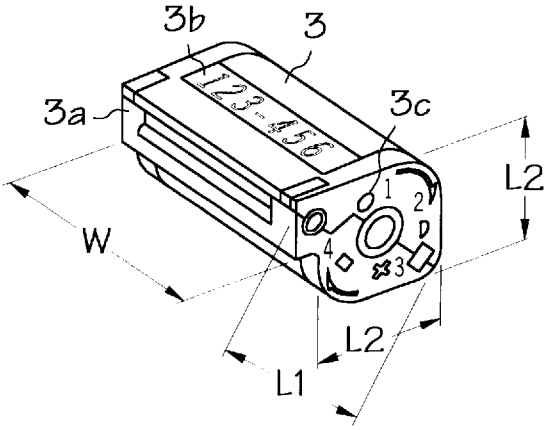
FIG. 2 is a perspective view showing a film cartridge.

Referring to the drawings, the embodiments of the present invention in connection with a holder structure of film cartridge are now discussed.

As shown in FIG. 1, a storage socket 1 is formed in a mount P (partly shown) made of a synthetic resin. The shape of the storage socket 1 is substantially identical to the shape of the lower half of a cartridge 3 (below the level at which a film exit port 3*a* is horizontally projected). The width (d) of the opening of the storage socket 1 is set to be slightly shorter than the minimum diagonal length (L2) of the cartridge 3 so that the lower half of the cartridge 3 is tightly seated into the storage socket. The storage socket 1 itself will not clamp the film cartridge 3. Since the film cartridge 3 is rounded as it runs downward from the film exit port 3*a*, elasticity of the material of the mount acts on the film cartridge 3 so that its film exit port 3*a* looks upward as shown in FIG. 4C.

A clamping plate portion 2 runs in parallel with the longitudinal edge of the storage socket 1, and extends upward from the top surface of the mount at a distance equal to the projection of the film exit port 3*a* from the near longitudinal edge of the storage socket. A locking projection 2*a* is formed on the top of the clamping plate portion 2 at its side looking to the storage socket. The locking projection 2*a* is engaged with the top edge of the frame of the film exit port 3*a* so that the cartridge is prevented from slipping out of the socket. The distance (d2) between the locking projection 2*a* and the far longitudinal edge 1*a* of the opening of the storage socket 1 is set to be slightly shorter than the corresponding diagonal length of the film cartridge 3. With its ID number facing upward, the film cartridge 3 is elastically clamped between the locking projection 2*a* and the far longitudinal edge 1*a* of the opening of the storage socket 1.

The length of the clamping plate portion 2 may be equal to that of the storage socket 1. Alternatively, the length of the clamping plate portion 2 may be set to be half as long as that of the storage socket 1 so that the film exit port 3*a* may be partly exposed. With this arrangement, the engagement of the locking projection may be easily released by pulling the film exit port 3*a*.

Figure 3A:
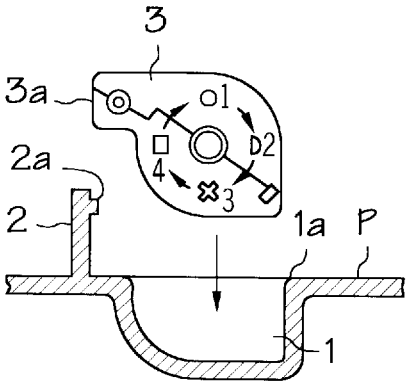
FIGS. 3A–3C show a storing operation of the cartridge into a storage socket.
Figure 3B:
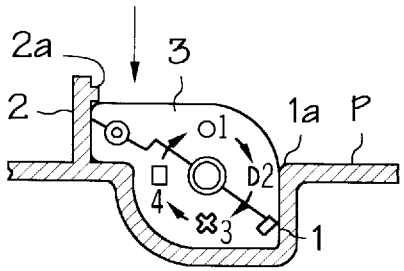
Figure 3C:
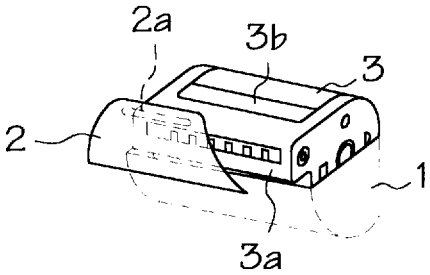

Discussed next is how to use the above holder structure. When the film cartridge 3 is mounted, the film cartridge 3 is pressed into the storage socket 1 with the film exit port 3*a* directly facing the locking projection 2 and with the surface bearing the ID number 3*b* looking upward. Press on the area of the ID number, and the lower half of the film cartridge 3 will be seated in the storage socket. The top edge of the frame of the film exit port 3*a* is engaged with the locking projection 2*a* of the clamping plate portion 2. In this way, the film cartridge 3 is clamped between the locking projection 2*a* and the far longitudinal edge 1*a* of the opening of the storage socket 1 (see FIGS. 3B and 3C). Since the ID number bearing surface of the film cartridge looks upward, identifying each film cartridge is easy.

Figure 4A:
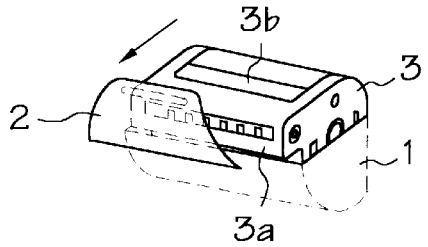
FIGS. 4A–4D show a retrieval operation of the cartridge out of the storage socket.
Figure 4B:
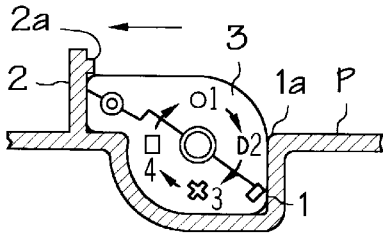
Figure 4C:
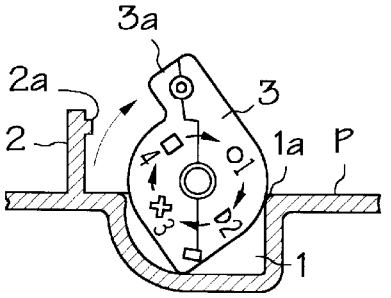
Figure 4D:
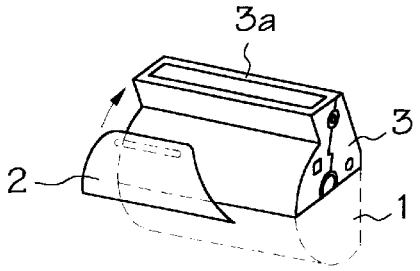

To pull the film cartridge, the clamping plate portion is pressed in the direction farther away from the film cartridge with a finger (see FIGS. 4A and 4B). The engagement of the locking projection 2*a* with the film exit port 3*a* is thus released, and the film cartridge 3 is flipped up with its film exit port 3*a* facing upward, by elasticity of the storage socket 1 (see FIGS. 4C and 4D). Now, the film cartridge 3 is easily taken out by picking its exit 3*a*.

Alternatively, by lightly pressing the portion of the film exit port 3*a* exposed horizontally next to the clamping plate portion 2 with a finger, the engagement of the film exit port 3*a* with the locking projection 2*a* will be released. The film cartridge 3 is easily taken out by picking its exit 3*a*.

Figure 5:
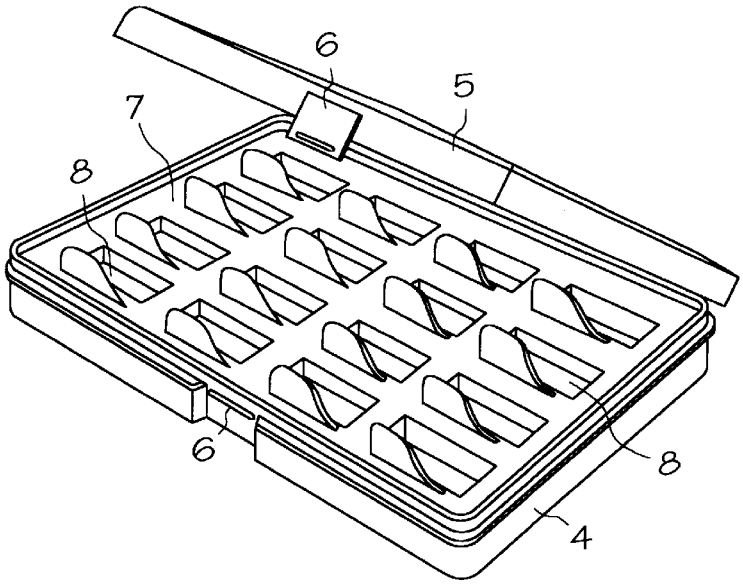
FIG. 5 is a perspective view showing a case into which the holder structure of the present invention is incorporated.

FIG. 5 shows an embodiment in which the holder structure of film cartridge is incorporated in a storage case with a cover. Shown in FIG. 5 are a base 4 of the storage case, and the cover 5 that is locked to the base 4 with clasps 6. Attached inside the base 4 is a storage mount 7 on which storage sections 8, each constructed of the holder structure described above, are arranged in rows and columns (16 storage sections are arranged in FIG. 5). According to the holder structure of the present invention, the film cartridge 3 is held with its ID number bearing surface looking upward, and thus the ID number 3*b* of each film cartridge 3 is visibly recognized in its storage condition. A target film cartridge is thus easily retrieved. Since the film cartridge is easily mounted and then retrieved, the storage sections 8 may be closely arranged with each other and a target film cartridge is quickly retrieved without any interference with other film cartridges.

As described above, in the holder structure of film cartridge of the present invention, a film cartridge is securely held by simply pressing a film cartridge into a storage socket until the film exit port is locked from above. To retrieve a film cartridge, the engagement of the locking projection with the film exit port is released by lightly pressing either the locking plate portion or the film exit port, and the film cartridge is ready to be picked up. The film cartridge is thus easily mounted and retrieved.

Since the film cartridge is picked up with fingers in its released and freed state rather than in its clamped state, the retrieval of the cartridge is smoothly performed. Even if the spacing between adjacent film cartridges is narrow, each cartridge is reliably picked up, and thus a number of film cartridges may be accommodated on a limited space.

The filing-box type album is now discussed.

Figure 6A:
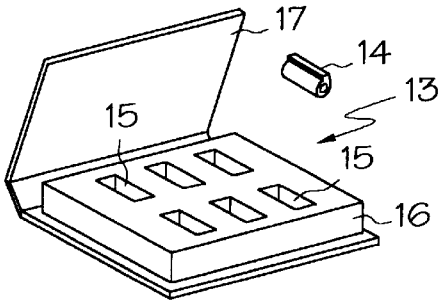
FIG. 6A is a perspective view of a container.
Figure 6B:
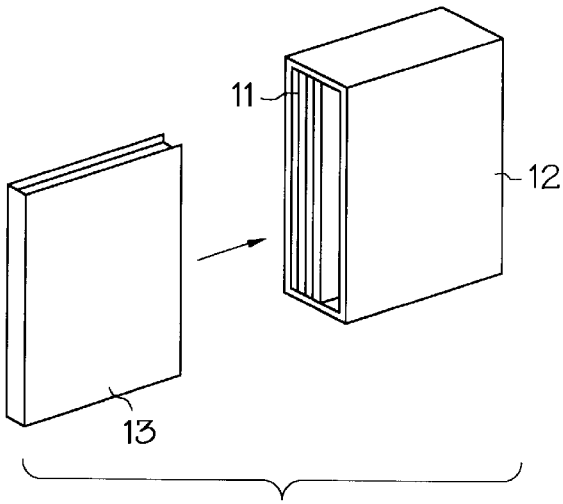
FIG. 6B is an explanatory view showing the container that is going to be stored in an outer casing.

Referring to FIG. 6, pocket albums 11 have consistent decorative covers with a popular character or a fancy design, for example. An outer casing 12 is so sized to accommodate together a plurality of pocket albums 11 (five pocket albums in FIG. 6) and a film cartridge container, and has a design consistent with that of each pocket album 11.

The container 13 of film cartridges 14 comprises a mount 16 having a plurality of storage sockets 15 for film cartridges 14 (six storage sockets in FIG. 6) and a cover 17 that is closed to cover entirely the storage sockets 15 and opened in a spread fashion to open the storage sockets 15. The cover 17 has a design consistent with that of the pocket album 11 and the outer casing 12. The container 13 is identical to the pocket albums 11 in shape and size except for their thicknesses so that all of them, namely, the outer casing 12 with the pocket albums 11 and the container 13 inserted is sold together.

Figure 7A:
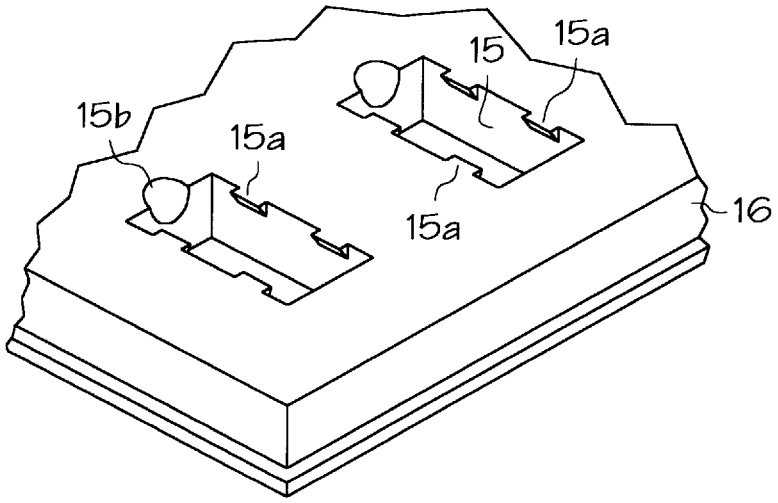
FIGS. 7A and 7B are enlarged perspective views of modifications of the storage socket.
Figure 7B:
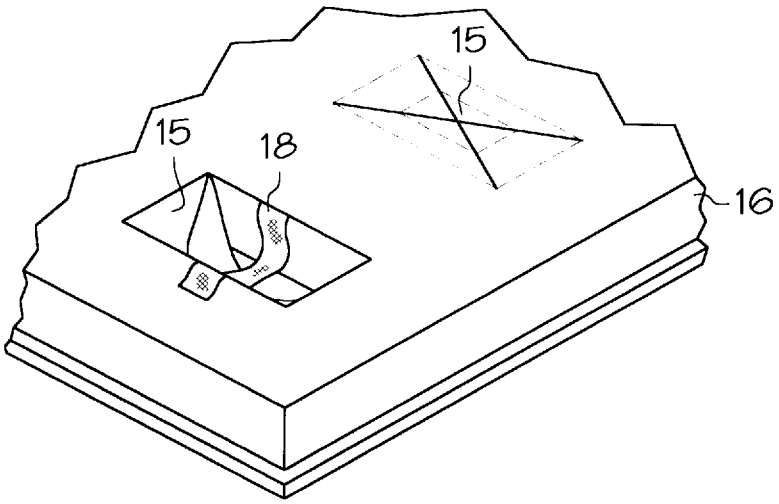

The mount 16 of the container 13 is fabricated of a synthetic resin such as expandable polystyrene and has storage sockets 15 on its top surface. Alternatively, a synthetic resin sheet may be pressed into a box having integrally storage sockets (see FIG. 7A), or a paper sheet is formed into a box while its top portion is partly cut in a cross to form four triangular areas, which are then bent downward inwardly to make storage sockets (see FIG. 7B). Each storage socket are provided with restraint means for preventing a film cartridge from slipping out of the storage socket, while being provided with pickup means (see FIGS. 7A and 7B).

As the restraint means for preventing a film cartridge from slipping out of the storage socket, the opening of the storage socket 15 is set to be slightly smaller than the size of the film cartridge so that elasticity of the synthetic resin is taken advantage of to keep the film cartridge seated. As another restraint means, locking projections 15*a* may be extended horizontally from the top surface of the mount into the opening of the storage socket. As yet another restraint means, a projection may be engaged with the holes at both ends of the spool of a film cartridge.

As pickup means for pulling a film cartridge out, a finger-size notch 15*b* for accommodating a finger therein is formed on one edge of the storage socket 15. Alternatively, a strip such as a ribbon 18 may be attached to one edge of the opening of the storage socket. The film cartridge is stored with the ribbon beneath it. To retrieve the film cartridge, the ribbon is pulled.

Figure 8A:
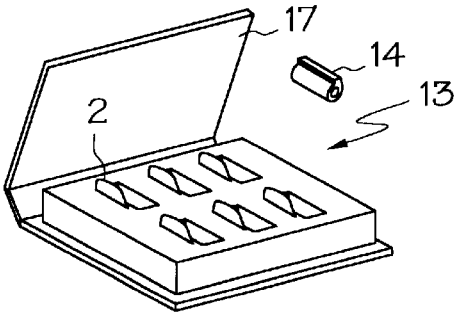
FIGS. 8A and 8B are explanatory perspective views showing a filing-box type album into which the holder structure of the present invention is incorporated.
Figure 8B:
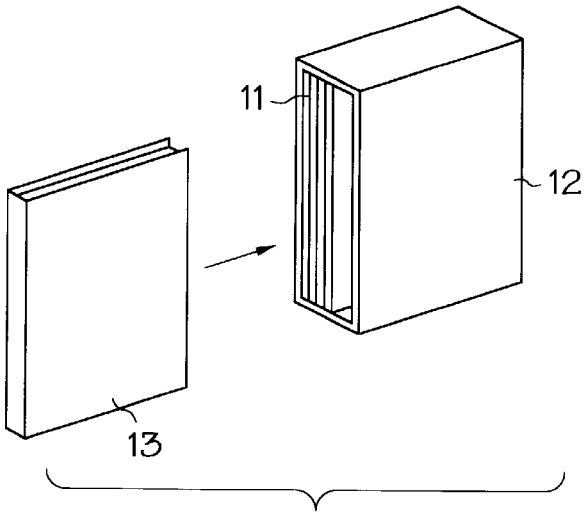

FIG. 8 shows the filing-box album into which the holder structure of the film cartridge is incorporated. The above holder structure is employed as the structure of the storage socket 15. The storage socket 15 and clamping plate portion 2 is formed in the container 13. The container 13 is closed with a cover 17, and is then stored along with pocket albums into the outer casing 12.

The filing-box album can store photographic prints and film cartridges together. Since the container is consistent with the outer casing of the album in style and design, the filing-box album is neatly kept on a bookshelf. If the album is kept on a bookshelf with the opening of the outer casing facing frontward, pocket albums only or a container only may be conveniently taken out. The container allows all the film cartridges to be recognized at a glance, and the storing and retrieval of the film cartridges are quite easy.

Figure 9:
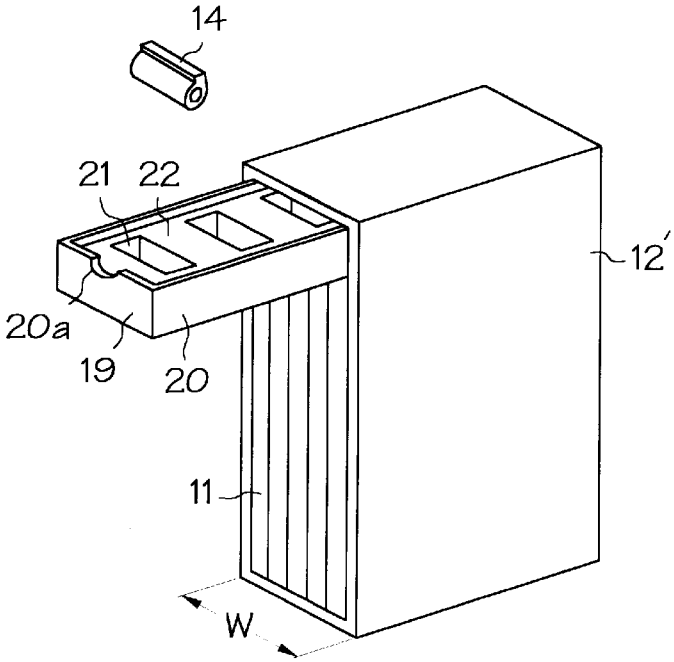
FIG. 9 is a perspective view of another embodiment of the present invention.

FIG. 9 shows another embodiment of the filing-box type album.

As shown, a container 19 stores the film cartridges 14. A box 20 contains a mount 22 having storage sockets 21. The box 20 has a width equal to the width (w) of an outer casing 12' storing a plurality of pocket albums, and is inserted above the pocket albums in a drawer fashion.

The box 20 is fabricated of a synthetic resin, and the mount 22 and the storage socket 21 may be constructed in the same way as in the preceding embodiment. Specifically, the mount 22 is fabricated of an expandable polystyrene or a synthetic resin sheet. The storage socket 21 is formed on top of the expandable polystyrene, or formed by pressing the synthetic resin sheet. The holder structure of film cartridge shown in FIG. 1 may also be used in the box 20. A notch 20*a* may be formed on the front face of the box 20 to help draw the box 20 by inserting a finger therethrough.

Figure 10A:
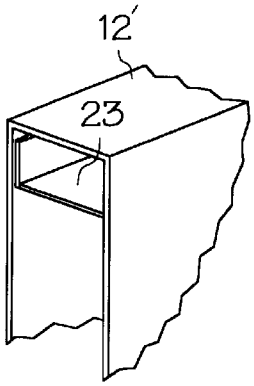
FIG. 10A is a perspective view showing a partition.
Figure 10B:
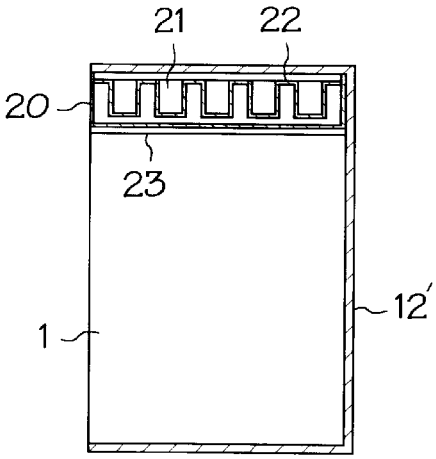
FIG. 10B is a cross-sectional view showing the filing-box type album in which the container is stored.
Figure 11:
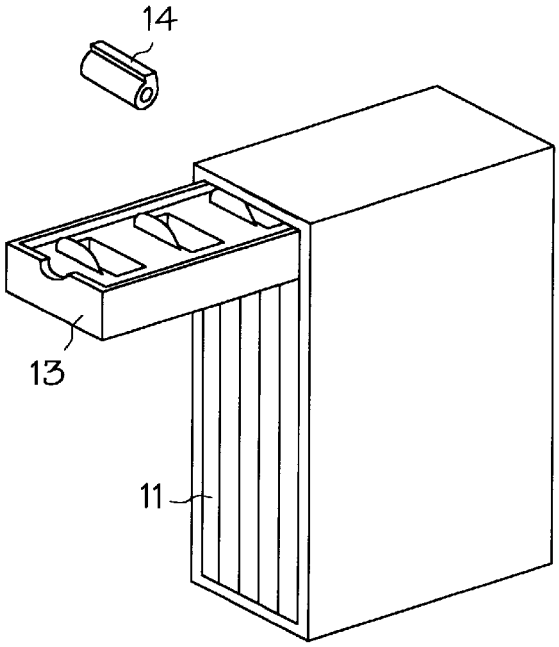
FIG. 11 is a perspective view showing a filing-box type album in which the holder structure of the present invention is incorporated.

A partition 23 may be arranged between the box 20 and the pocket albums 11 in the outer casing 12' so that the pocket albums 11 and the box 20 are independently stored or retrieved (see FIG. 10). In the embodiment shown in FIG. 6, such a partition may be arranged between the pocket albums 11 and the container 13 having a style identical to that of the pocket album.

The container 19 has the same advantage if a partition is arranged on the bottom side of the outer casing 12'.

The container stored on the top side or bottom side of the outer casing presents the following advantage besides the advantages already described above. Each pocket album changes its thickness depending on the number of photographic prints actually held therein. As the thickness of the pocket album increases, storing and retrieving the pocket album and container in the same style and design encounter slight resistance and takes a little bit more time. In this embodiment, the pocket albums and the container are independently stored and retrieved.

As described above, the filing-box type album stores together a plurality of albums and the container storing film cartridges, dispersing of the film cartridges is prevented. Either the pocket albums only or the container only may be retrieved for looking or managing them.

In view of the conventional filing-box type album, the filing-box type album of the present invention is enlarged in its width across or height so that the container of film cartridges is together stored, and thus the conventional pocket albums themselves are continuously used. With the outer casing slightly modified in size, the album is designed to be compatible with the new Advanced Photo System. Costs involved in the transition to the new Advanced Photo System is substantially reduced.

Figure 12:
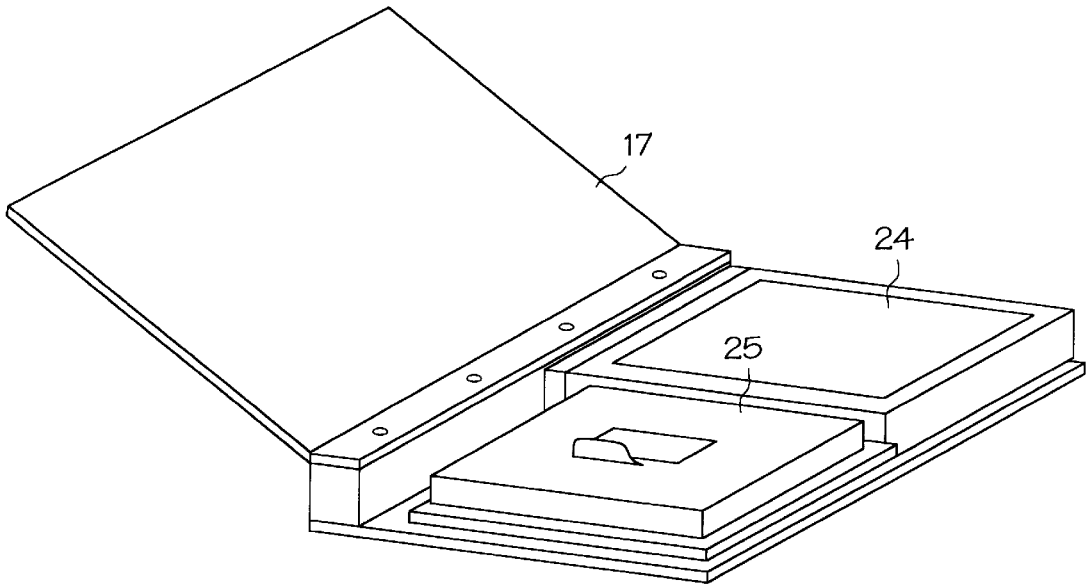
FIG. 12 is a perspective view showing a mount in which the holder structure of the present invention is incorporated.

The holder structure of film cartridge and the filing-box type album have been described. The holder structure of film cartridge is applied to a conventional binder type album with screws as shown in FIG. 12. As shown in FIG. 12, mounts 24 having a shorter vertical length than a conventional one are attached and a mount 25 having a storage socket of film cartridge is bound at a space conserved.

What is claimed is:

1. A holder structure of a film cartridge comprising a mount fabricated of a synthetic resin comprising a storage socket having two longitudinal and two lateral sides, being substantially identical in shape to the lower half of a film cartridge so that the lower portion of the film cartridge is completely received in the storage socket, and a clamping plate portion which is positioned parallel to a longitudinal side of the storage socket and which is spaced away from the storage socket by a distance corresponding to the projection of a film exit port of the film cartridge, wherein the clamping plate portion has, on the side of the top portion facing the storage socket, a locking projection that engages with the top edge of the frame of the film exit port.

2. A holder structure of a film cartridge according to claim 1, wherein the length of the clamping plate portion is set to be shorter than the length of the storage socket so that the film exit port of the film cartridge is partly exposed.

3. A filing-box type album with a film cartridge container comprising a plurality of pocket albums, an outer casing into which the pocket albums are inserted, and a container for film cartridges which is also inserted into the outer casing wherein the filing-box type album with a film cartridge container has a holder structure comprising a storage socket having two longitudinal and two lateral sides, being substantially identical in shape to a lower half of a film cartridge so that the lower half of the film cartridge is completely received in the storage socket, and a clamping plate portion which is positioned parallel to a longitudinal side of the storage socket and which is spaced away from the storage socket by a distance corresponding to a projection of a film exit port of the film cartridge, wherein the clamping plate portion has, on a side of the top portion facing the storage socket, a locking projection that engages with the top edge of the frame of the film exit port.

4. A filing-box type album with a film cartridge container comprising a plurality of pocket albums, an outer casing into which the pocket albums are inserted, and a container for film cartridges which is also inserted into the outer casing wherein the container comprises a mount comprising a plurality of storage sockets for film cartridges, and a cover which covers the storage sockets and which is openable in a spread fashion in the same style as the pocket albums wherein a partition is arranged to separate the pocket albums from the container in the outer casing.

5. A filing-box type album with a film cartridge container according to claim 4 wherein the filing-box type album with a film cartridge container has a holder structure comprising a storage socket having two longitudinal and two lateral sides, being substantially identical in shape to a lower half of a film cartridge so that the lower half of the film cartridge is completely received in the storage socket, and a clamping plate portion which is positioned parallel to a longitudinal side of the storage socket and which is spaced away from the storage socket by a distance corresponding to a projection of a film exit port of the film cartridge, wherein the clamping plate portion has, on a side of the top portion facing the storage socket, a locking projection that engages with the top edge of the frame of the film exit port.

6. A filing-box type album with a film cartridge container comprising a plurality of pocket albums, an outer casing into which the pocket albums are inserted, and a container for film cartridges which is also inserted into the outer casing wherein a partition is arranged to separate the pocket albums from the container in the outer casing and the partition creates a cavity so that the container may be inserted in the outer casing in a drawer fashion.

7. A filing-box type album with a film cartridge container according to claim 6 wherein the filing-box type album with a film cartridge container has a holder structure comprising a storage socket having two longitudinal and two lateral sides, being substantially identical in shape to a lower half of a film cartridge so that the lower half of the film cartridge is completely received in the storage socket, and a clamping plate portion which is positioned parallel to a longitudinal side of the storage socket and which is spaced away from the storage socket by a distance corresponding to a projection of a film exit port of the film cartridge, wherein the clamping plate portion has, on a side of the top portion facing the storage socket, a locking projection that engages with the top edge of the frame of the film exit port.

* * * * *